US005109896A

United States Patent [19]

Tomes et al.

[11] Patent Number: 5,109,896

[45] Date of Patent: May 5, 1992

[54] MACHINE FOR SHARPENING WOODEN STAKE

[75] Inventors: Christopher B. Tomes, Arlington Heights; Edward M. R. Tomes, Wheeling, both of Ill.

[73] Assignee: Foxcroft Capital Corp., Hamilton, Canada

[21] Appl. No.: 732,074

[22] Filed: Jul. 18, 1991

[51] Int. Cl.[5] ..... B27M 3/00; B27C 1/00; E04H 15/62

[52] U.S. Cl. ..... 144/30; 135/118; 144/162.13; 144/172; 144/174; 144/241

[58] Field of Search ..... 135/118; 144/2 R, 30, 144/162 R, 162 B, 172, 174, 241

[56] References Cited

U.S. PATENT DOCUMENTS

| | | | |
|---|---|---|---|
| 729,591 | 6/1903 | Jacob | 135/118 |
| 1,105,884 | 8/1914 | Crites | 135/118 |
| 2,358,089 | 9/1944 | Gere | 135/118 |
| 2,674,252 | 4/1954 | Finlayson et al. | 135/118 |
| 2,835,017 | 5/1958 | Hoerr | 135/118 |

*Primary Examiner*—W. Donald Bray
*Attorney, Agent, or Firm*—Dressler, Goldsmith, Shore, Sutker & Milnamow, Ltd.

[57] ABSTRACT

A wooden stake having a sharpened end with bevelled faces and having a striking end with bevelled faces is made on a novel machine by a novel method. Each bevelled face intersects a substantially planar face of the wooden stake and conforms substantially to a portion of a right circular cylinder. The machine has a sharpening drum carrying a multiplicity of removable cutting blades, which are mounted to a tubular wall of the drum, along an interior surface of such wall. The machine has an enclosure for the drum, a table mounted to the enclosure, and a fence mounted to the table at a suitable angle relative to a portal of the enclosure. A motor is provided for driving the drum. The table and fence are useful for guiding the stake through the portal, against the blades, which cut into the stake.

5 Claims, 3 Drawing Sheets

MACHINE FOR SHARPENING WOODEN STAKE

TECHNICAL FIELD OF THE INVENTION

This invention pertains to a novel machine for sharpening a wooden stake, a novel method for sharpening a wooden stake, and a wooden stake having a novel, sharpened shape with bevelled faces, each of which conforms substantially to a portion of a right circular cylinder.

BACKGROUND OF THE INVENTION

Wooden stakes are used in countless numbers in concrete-paving work wherein such stakes ar used to stabilize concrete-pouring forms. Usually, such a stake is sharpened at one end so as to facilitate pounding the sharpened stake into earth, as by striking an opposite end of the sharpened stake with a sledge hammer.

Conventionally, wooden stakes are sharpened with power saws or with hand tools, such as hatchets. As sharpened therewith, such stakes tend to have substantially flat, bevelled faces at their sharpened ends.

Often, at a jobsite, it tends to be very inconvenient to resharpen used wooden stakes. Consequently, used wooden stakes having dulled, frayed, or broken ends tend to be commonly discarded, rather than resharpened.

There has been a need for a machine, which may be conveniently employed at a jobsite, for sharpening new wooden stakes and for resharpening used wooden stakes. This invention is addressed to such need.

SUMMARY OF THE INVENTION

In addressing the need noted above, this invention provides a wooden stake having a novel, sharpened shape. The wooden stake may be conveniently described as having a sharpened end and a striking end, although the striking end may be also bevelled, as described below. The wooden stake has four substantially planar faces defining a substantially rectangular shape in cross-section between the sharpened and striking ends. The sharpened end has plural bevelled faces, two in certain contemplated embodiments and four in another contemplated embodiment. Each bevelled face of the sharpened end intersects a respective one of the substantially planar faces. According to this invention, each bevelled face of the sharpened end conforms substantially to a portion of a right circular cylinder.

In certain contemplated embodiments, the sharpened end has two such bevelled faces alternating with substantially triangular portions of two such substantially planar faces. In one such embodiment, which may be made from a so-called "two by four" wooden board, the substantially planar faces are constituted by two relatively narrow faces and two relatively wide faces, and each bevelled face of the sharpened end intersects a respective one of the relatively narrow faces. In another contemplated embodiment, which may be made from a so-called "two by two" wooden board, the sharpened end has four such bevelled faces.

As an enhancement, the striking end of the wooden stake may have two bevelled faces, each intersecting a respective one of the substantially planar faces on a respective one of two opposite sides of the wooden stake, and each conforming substantially to a portion of a right circular cylinder. The bevelled faces at the striking end help to minimize fraying of the wooden stake when and where struck at the striking end by a sledge hammer. It is preferred that the bevelled faces of the sharpened end and the bevelled faces of the striking end intersect the same ones of the substantially planar faces.

Moreover, this invention provides a novel machine for sharpening a wooden stake having four substantially planar faces defining a substantially rectangular shape in cross-section, as described above. The novel machine, which may be conveniently employed at a jobsite, can produce any of the aforenoted embodiments of the wooden stake provided by this invention.

Broadly, the novel machine comprises a frame, a sharpening drum mounted rotatably to the frame for rotation about an axis, a guiding structure, and a driving device. The sharpening drum has an interior surface with multiple cutting means arrayed along the interior surface and arranged collectively to sweep a cylindrical path when the sharpening drum is driven rotatably. The guiding structure is used for guiding a wooden stake against the cutting means with the wooden stake extending at an acute angle relative to the axis. The driving device is used for driving the sharpening drum rotatably.

In one contemplated embodiment, the novel machine comprises an enclosure having a portal defining a plane, a table mounted to the enclosure, and a fence mounted to the table at an acute angle relative to such plane. The table and the fence are used for guiding a wooden stake into the enclosure, through the portal, in such manner that one substantially planar face of the wooden stake bears against the table and that another substantially planar face thereof bears against the fence.

In the aforenoted embodiment, the novel machine comprises a sharpening drum, which is mounted rotatably within the enclosure, and which is arranged to be rotatably driven in a given rotational direction. A motor is provided for driving the sharpening drum. The sharpening drum, which has a tubular wall, carries multiple cutting blades. The cutting blades are arrayed along an interior surface of the tubular wall. The cutting blades are arranged collectively to sweep a closed path conforming substantially to a right circular cylinder when the sharpening drum is driven. The cutting blades cut into a wooden stake guided into the enclosure, against the cutting blades, so as to provide the wooden stake with a bevelled surface. The bevelled surface, which intersects one of the substantially planar faces, conforms substantially to a portion of a right circular cylinder.

Preferably, in the novel machine, the sharpening drum is arranged so that the cutting blades move downwardly past a wooden stake disposed on the table and guided into the enclosure, against the cutting blades, so as to cut into the wooden stake when the sharpening drum is driven. Furthermore, as a preferred feature, each cutting blade may be removably mounted to the tubular wall.

Furthermore, this invention provides a novel method for sharpening a wooden stake having four substantially planar faces defining a substantially rectangular shape in cross-section, as described above. The novel method is characterized by steps of cutting into the wooden stake so as to provide a sharpened end of the wooden stake with bevelled faces, each of which intersects a respective one of the substantially planar faces, and each of which conforms substantially to a right circular cylinder.

The cutting steps may be advantageously performed so as to provide two such bevelled faces, which alternate with substantially triangular portions of two such substantially planar faces, or to provide the sharpened end with four such bevelled faces. If the substantially planar faces are constituted by two relatively narrow faces and two relatively wide faces, the cutting steps may be advantageously performed in such manner that each of two bevelled faces of the sharpened end intersects a respective one of the relatively narrow faces.

The novel method may be further characterized by cutting into the wooden stake so as to provide an opposite, striking end of the wooden stake with two bevelled surfaces, each of which intersects a respective one of the substantially planar faces on a respective one of two opposite sides of the wooden stake, and each of which conforms substantially to a portion of a right circular cylinder. It is preferred that the cutting steps are performed in such manner that the bevelled faces of the sharpened end and the bevelled faces of the striking end intersect the same ones of the substantially planar faces.

These and other objects, features, and advantages of this invention are evident from the following description of several wooden stakes according to this invention and a stake-sharpening machine according to this invention, with reference to the accompanying drawings.

DETAILED DESCRIPTION OF ILLUSTRATED EMBODIMENTS

Figure 1:
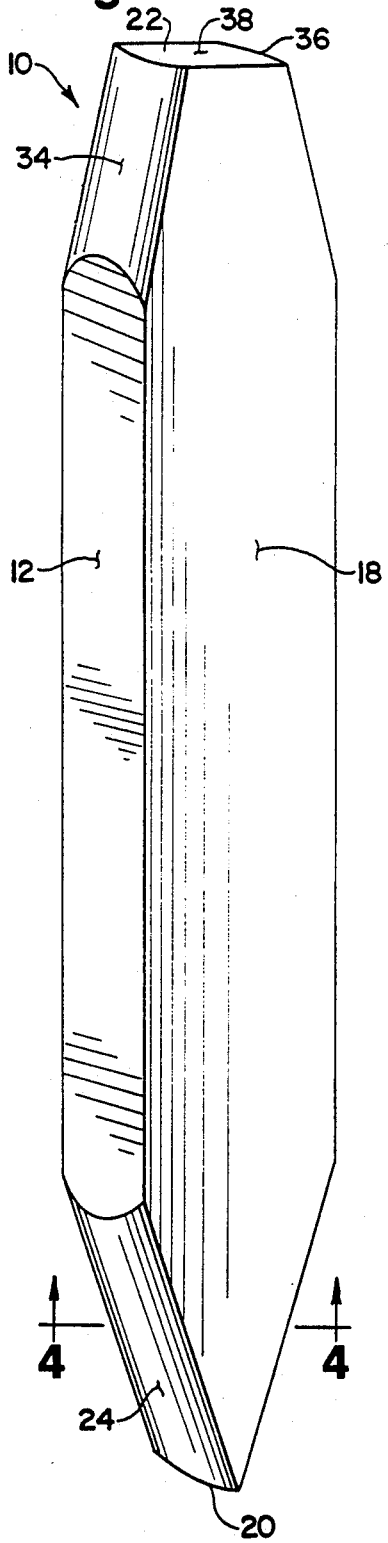
FIG. 1 is a perspective view of one contemplated embodiment of a wooden stake according to this invention.
Figure 2:
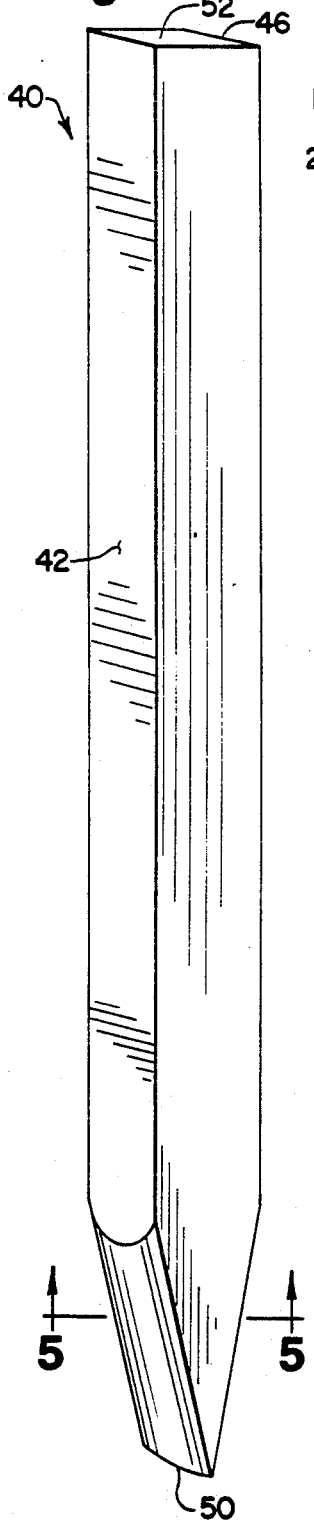
FIG. 2 is a perspective view of another contemplated embodiment of a wooden stake according to this invention.
Figure 3:
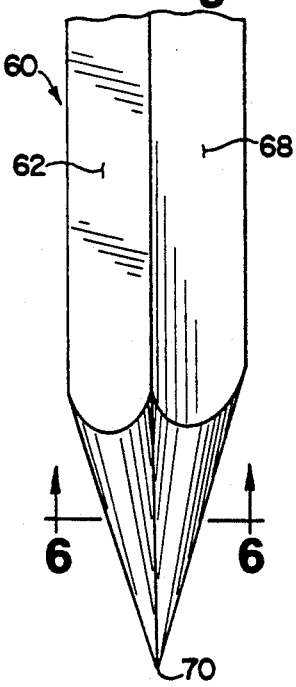
FIG. 3 is a fragmentary, perspective view of yet another contemplated embodiment of a wooden stake according to this invention.
Figure 7:
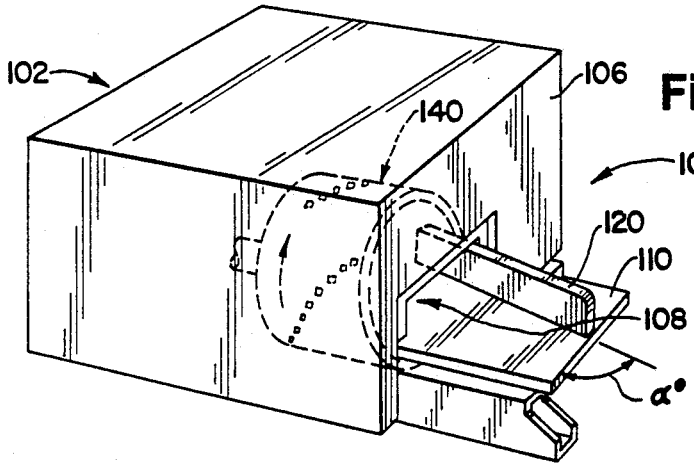
FIG. 7, on a smaller scale compared to FIGS. 1 through 6, is a perspective view of a machine according to this invention for sharpening a wooden stake.
Figure 8:
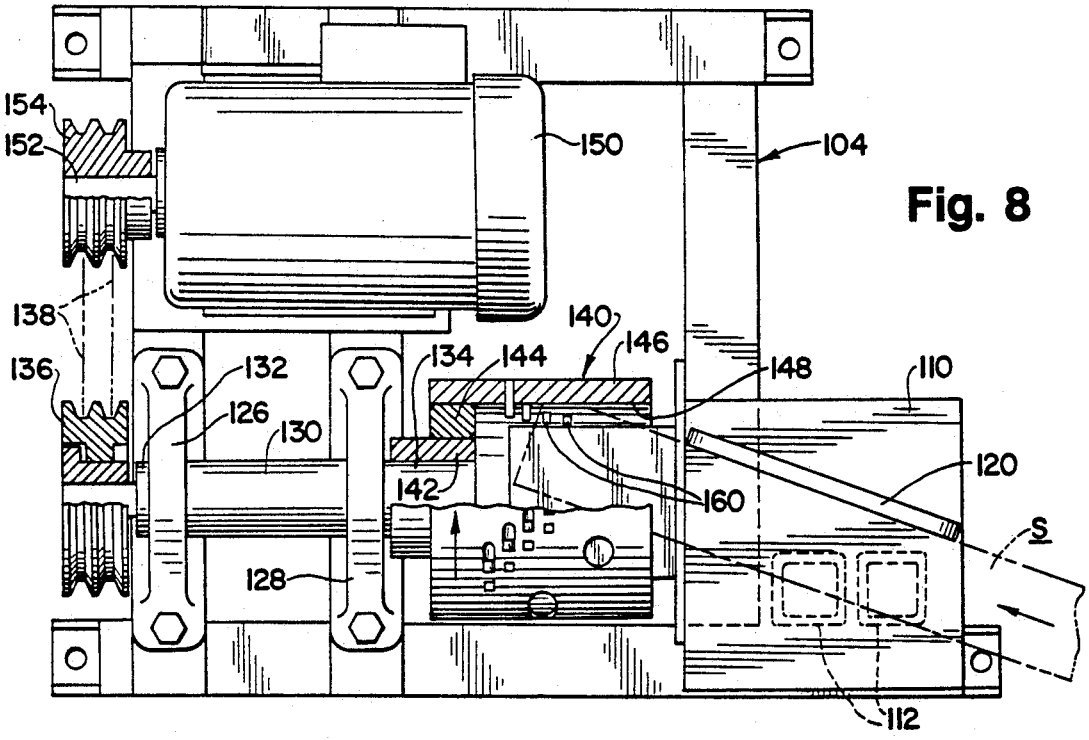
FIG. 8, on a larger scale compared to FIG. 7, is a plan view of the machine with upper portions removed to reveal other portions. A wooden stake is shown in phantom lines.
Figure 9:
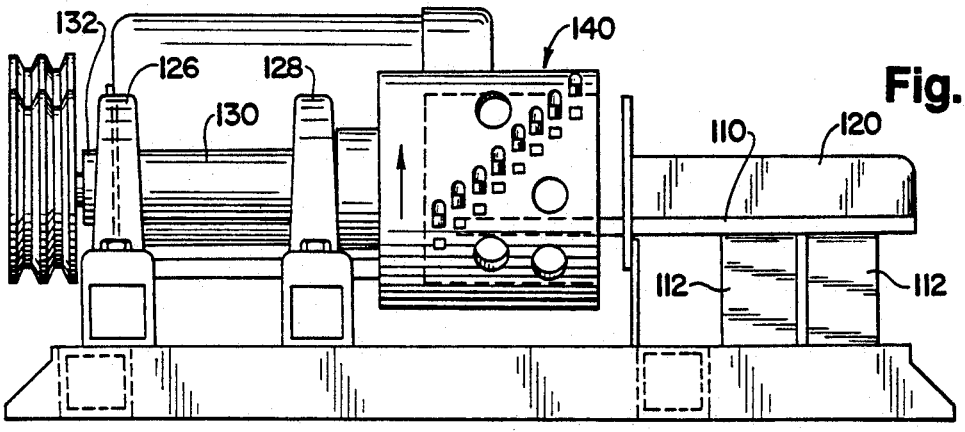
FIG. 9 is an elevational view of the machine, as shown in FIG. 8.
Figure 10:
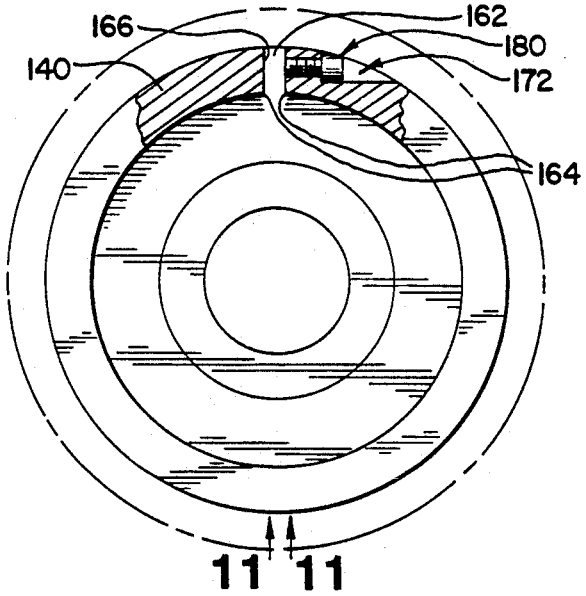
FIG. 10, on a larger scale compared to FIGS. 8 and 9, is an end view of a sharpening drum of the machine. In a broken-away region, one of multiple cutting blades is shown.
Figure 11:
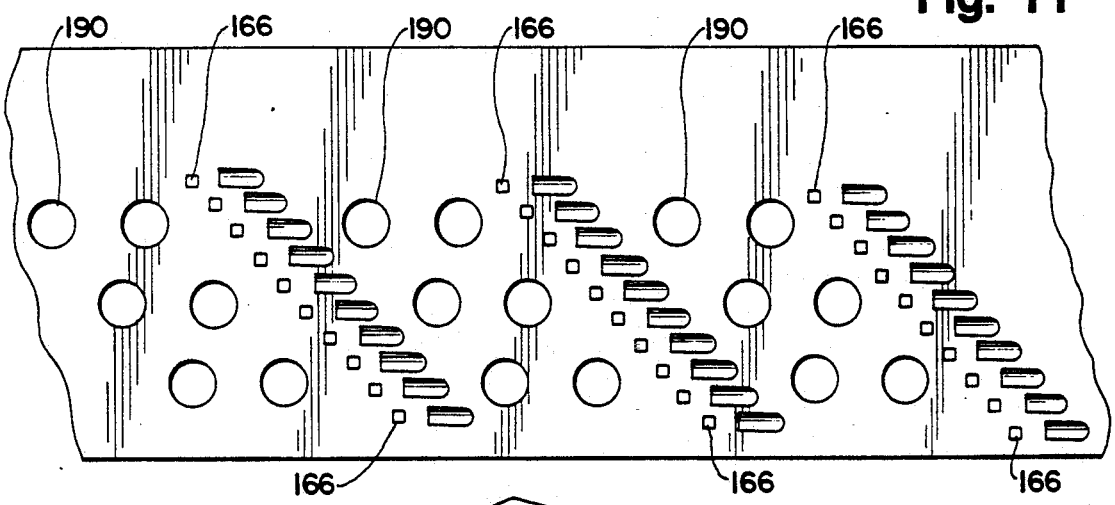
FIG. 11 is a fragmentary development of a tubular wall of the sharpening drum, as taken along line 11—11 of FIG. 10, in a direction indicated by arrows, and as flattened.
Figure 12:
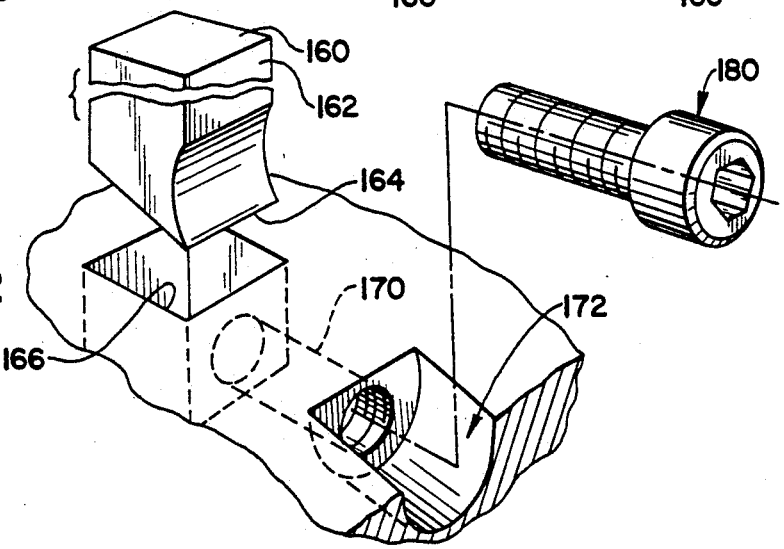
FIG. 12 is a further enlarged, fragmentary, exploded, perspective view of one of the cutting blades, along with a threaded fastener, as used to mount the cutting blade to the tubular wall of the sharpening drum.

Several embodiments of wooden stakes according to this invention are shown in FIGS. 1, 2, and 3. Each wooden stake shown therein has a sharpened end having plural bevelled faces providing such wooden stake with a novel, sharpened shape, which is utilitarian. Each bevelled face of the sharpened end conforms substantially to a portion of a right circular cylinder.

Figure 4:
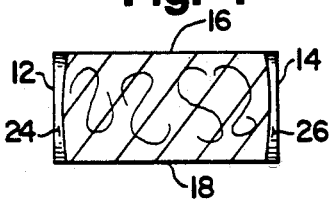
FIG. 4 is a cross-sectional view taken along line 4—4 of FIG. 1, in a direction indicated by arrows.

As shown in FIGS. 1 and 4, a wooden stake 10 is made from a so-called "two by four" board of a suitable wood, such as southern pine, with four substantially planar faces defining a substantially rectangular cross-section, namely two relatively narrow, substantially planar faces 12, 14, and two relatively wide, substantially planar faces 16, 18. The wooden stake 10 has a sharpened end 20 and an opposite, striking end 22.

The sharpened end 20 has two bevelled faces 24, 26, each of which conforms substantially to a portion of a right circular cylinder. The bevelled face 24 intersects the relatively narrow face 12. The bevelled face 26 intersects the relatively narrow face 14. The bevelled faces 24, 26, alternate with substantially triangular portions of the relatively wide faces 16, 18. The bevelled faces 24, 26, are disposed so as to draw each of the relatively wide faces 16, 18, to a sharp point. The sharpened end 20 facilitates pounding the wooden stake 10 into earth (not shown) by striking the striking end 22 with a sledge hammer (not shown) or another suitable tool.

The striking end 22 has two bevelled faces 34, 36, each of which conforms substantially to a portion of a right circular cylinder. The bevelled face 34 intersects the relatively narrow face 12. The bevelled face 36 intersects the relatively narrow face 14. The bevelled faces 34, 36, are disposed so as to leave an oblong striking area 38 on the striking end 22. The bevelled faces 34, 36, help to minimize fraying of the wooden stake 10 when and where struck by a sledge hammer or another suitable tool.

Figure 5:
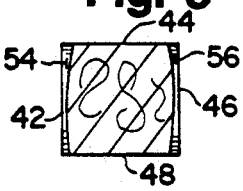
FIG. 5 is a cross-sectional view taken along line 5—5 of FIG. 2, in a direction indicated by arrows.

As shown in FIGS. 2 and 5, a wooden stake 40 is made from a so-called "two by two" board of a suitable wood, such as southern pine, with four substantially planar faces defining a substantially square cross-section, namely four substantially planar faces 42, 44, 46, 48, of substantially equal widths. The wooden stake 40 has a sharpened end 50 and an opposite, striking end 52.

The sharpened end 50 has two bevelled faces 54, 56, each of which conforms substantially to a portion of a right circular cylinder. The bevelled face 54 intersects the substantially planar face 42. The bevelled face 56 intersects the substantially planar face 46. The bevelled faces 54, 56, alternate with substantially triangular portions of the substantially planar faces 46, 48. The bevelled faces 54, 56, are disposed so as to draw each of the substantially planar faces 44, 48, to a sharp point. The sharpened end 50 facilitates pounding the wooden stake 40 into earth by striking the striking end 22 with a sledge hammer or other suitable tool.

Figure 6:
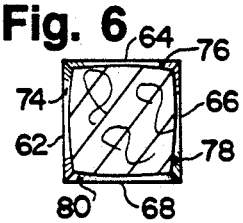
FIG. 6 is a cross-sectional view taken along line 6—6 of FIG. 3, in a direction indicated by arrows.

As shown in FIGS. 3 and 6, a wooden stake 60 has four substantially planar faces 62, 64, 66, 68, of substantially equal widths and is similar to the wooden stake 40 except that the wooden stake 60 has a sharpened end 70 having four bevelled faces 74, 76, 78, 80, each of which intersects a respective one of the substantially planar faces 62, 64, 66, 68, and each of which conforms substantially to a right circular cylinder.

The wooden stake 10 is preferred for heavy duty applications. The wooden stake 40 is preferred for light duty applications. Each of the wooden stakes 10, 40, 60, can be conveniently made at a jobsite or elsewhere by a machine 100, which is shown in FIGS. 7 through 12.

The machine 100 comprises an enclosure 102 including a lower frame 1204 and an upper cover 106, which is removable from the lower frame 106, and which has a rectangular portal 108 defining a vertical plane. The machine 100 comprises a table 110, which is mounted to the frame 104 via upright members 112 so as to extend through a lower portion of the portal 108, and a fence 120, which is mounted to the table 110 at an acute angle (e.g. about 70°) relative to the vertical plane defined by the portal 108. The fence 120 is mounted to the table 110 so as to extend through an upper portion of the portal 108. The table 110 and the fence 120 are arranged to guide a wooden stake bearing downwardly against the table 110 and laterally against the fence 120, such as the wooden stake S shown in phantom lines in FIG. 8, at a similar angle, through the portal 108, into the enclosure 102.

Two journal blocks 126, 128, are mounted on the lower frame 102, within the enclosure 102. A shaft 130, which has a first end 132 extending away from the portal 108 and a second end 134 extending toward the portal 108, is journalled in the journal blocks 126, 128. The shaft 130 defines an axis. A pulley sheave 136 is mounted on the first end of the shaft 130 for conjoint rotation with the shaft 130. The pulley sheave 136 is designed to accommodate two pulley belts 138, which are suggested in phantom lines in FIG. 8.

A sharpening drum 140 is mounted on the second end 134 of the shaft 130 for conjoint rotation with the shaft 130 about the axis defined by the shaft 130. The sharpening drum 140 comprises a hub 142, which is mounted on the shaft end 134 for conjoint rotation with the shaft 130, an annular spacer 144, which is welded to and around the hub 142, and a tubular wall 146, which is welded to and around the annular spacer 144 so as to extend axially from the annular spacer 144, toward the portal 108. The tubular wall 146 has an interior surface 148, which defines a sharpening cavity opening toward the portal 108. A wooden stake disposed on the table 110, against the fence 120, can be thus guided into the sharpening cavity, toward the interior surface 148.

An electric motor 150, which is arranged to drive a shaft 152 in a given rotational direction, is mounted on the lower frame 102, in such manner that the shaft 152 is parallel to the shaft 130. A pulley sheave 154 is mounted to the shaft 152 for conjoint rotation with the shaft 152. The pulley sheave 154 is designed to accommodate the pulley belts 138, which are arranged to drive the pulley sheave 136, the shaft 130, and the sharpening drum 140 in the same rotational direction.

The sharpening drum 140 carries three staggered rows of staggered cutting blades 160, which are arrayed along the interior surface 148 with ten cutting blades 160 in each such row. The cutting blades 160 are arranged collectively to sweep a closed path confirming substantially to a right circular cylinder when the sharpening drum 140 is driven in the aforenoted rotational direction. The sharpening drum 140 is arranged so that the cutting blades 160 move downwardly past a wooden stake disposed on the table 110 and guided into the enclosure 102, against the cutting blades 160, so as to cut into the wooden stake when the sharpening drum 140 thus is driven.

Each cutting blade 160 has an elongate, square shank 162 having a sharp edge 164, which may be carbide-tipped. Each cutting blade 160 is mounted removably to the tubular wall 146. The tubular wall 146 has multiple square apertures 166 extending through the tubular wall 146 so as to accommodate the respective blades 160. Each cutting blade 160 is inserted to a desired depth into a respective one of the apertures 166 in such manner that the sharp edge 164 of such cutting blade 160 is oriented properly.

At each aperture 166, a threaded bore 170 communicates between one face of such aperture 166 and an exterior recess 172, which is provided in the tubular wall 146. A threaded fastener 180 is threaded into the threaded bore 170, against the shank 162 of the cutting blade 160 inserted into such aperture 166, so as to retain such cutting blade 160 in such aperture 166, at the desired depth.

As shown, circular holes 190 are drilled through the tubular wall 146, as and where required to balance the sharpening drum 140 dynamically.

If a wooden stake having four substantially planar faces defining a substantially rectangular cross-section, as described above, is disposed on the table 110, against the fence 120, and is guided into the enclosure 102, toward the cutting blades 160, while the sharpening drum 140 is being driven in the aforenoted rotational direction, the cutting blades 160 cut into the wooden stake so as to provide a sharpened end of the wooden stake with a bevelled surface, which intersects one such substantially planar face. Each bevelled face on the sharpened end conforms substantially to a portion of a right circular cylinder.

Thereupon, the sharpened end can be similarly provided with another such bevelled face or with three more such bevelled faces, whichever is appropriate for the wooden stake. If the sharpened end is provided with two such bevelled faces, the opposite, striking end of the wooden stake can be similarly provided with two such bevelled faces, each on an opposite side of the wooden stake, and each intersecting a respective one of the substantially planar faces intersected by one of the two bevelled faces on the sharpened end.

Therefore, the machine 10 can be conveniently employed at a jobsite or elsewhere to make any of the wooden stakes 10, 40, 60, or to resharpen a Wooden stake so that the resharpened stake is similar to any of the wooden stakes 10, 40, 60.

Various modifications may be made in the preferred embodiment described above without departing from the scope and spirit of this invention.

We claim:

1. A machine for sharpening a wooden stake having four substantially planar faces defining a substantially rectangular shape in cross-section, the machine comprising (a) an enclosure having a portal defining a plane, a table mounted to the enclosure, and a fence mounted to the table at an acute angle relative to the plane defined by the portal, wherein the table and the fence constitute means for guiding a wooden stake into the enclosure, through the portal, in such manner that one substantially planar face of the wooden stake bears against the table and that another substantially rectangular face of the wooden stake bears against the fence, (b) a sharpening drum mounted rotatably within the enclosure and arranged to be rotatably driven in a given rotational direction about an axis, the sharpening drum having a tubular wall with an interior surface and carrying multiple cutting blades arrayed along the interior surface, the cutting blades being arranged collectively to sweep a closed path conforming substantially to a right circular cylinder when the sharpening drum thus is driven and constituting means for cutting into a wooden stake guided into the enclosure, through the portal, in said manner so as to provide an end of the wooden stake with a bevelled surface, which intersects one of the substantially planar faces, and which conforms substantially to a portion of a right circular cylinder, and (c) means comprising a motor for driving the sharpening drum in the given rotational direction about the axis.

2. The machine of claim 1 wherein the sharpening drum is arranged so that the cutting blades move downwardly past a wooden stake disposed on the table and guided into the enclosure, through the portal, in said manner so as to cut into the wooden stake when the sharpening drum thus is driven.

3. The machine of claim 2 wherein the sharpening drum is arranged so that the axis extends through the portal.

4. The machine of claim 1 wherein the sharpening drum comprises means for mounting each cutting blade removably to the tubular wall.

5. A machine for sharpening a wooden stake having four substantially planar faces defining a substantially rectangular shape in cross-section, the machine comprising (a) a frame, (b) a sharpening drum mounted rotatably to the frame for rotation about an axis, the sharpening drum having an interior surface with multiple cutting means arrayed along the interior surface, the cutting means being arranged collectively to sweep a cylindrical path when the sharpening drum is driven rotatably, (c) means for guiding a wooden stake against the cutting means with the wooden stake extending at an acute angle relative to the axis, and (d) means for driving the sharpening drum rotatably.

* * * * *